US009297523B2

(12) United States Patent
MacKay

(10) Patent No.: US 9,297,523 B2
(45) Date of Patent: Mar. 29, 2016

(54) LED STICKERS

(71) Applicant: Jill MacKay, Bellvue, CO (US)

(72) Inventor: Jill MacKay, Bellvue, CO (US)

( * ) Notice: Subject to any disclaimer, the term of this patent is extended or adjusted under 35 U.S.C. 154(b) by 34 days.

(21) Appl. No.: 14/459,237

(22) Filed: Aug. 13, 2014

(65) Prior Publication Data

US 2016/0047534 A1 Feb. 18, 2016

(51) Int. Cl.

| | |
|---|---|
| ***F21V 21/08*** | (2006.01) |
| ***F21V 23/06*** | (2006.01) |
| ***F21V 23/02*** | (2006.01) |
| *F21Y 101/02* | (2006.01) |
| *F21W 131/40* | (2006.01) |

(52) U.S. Cl.

CPC ..... *F21V 21/0808* (2013.01); *F21V 23/02* (2013.01); *F21V 23/06* (2013.01); *F21W 2131/40* (2013.01); *F21Y 2101/02* (2013.01)

(58) Field of Classification Search

USPC ..... 362/382

See application file for complete search history.

(56) References Cited

U.S. PATENT DOCUMENTS

| | | | | |
|---|---|---|---|---|
| 6,013,346 | A * | 1/2000 | Lewis | A44C 15/0015 156/250 |
| 7,065,910 | B2 * | 6/2006 | Woodruff | G09F 7/12 362/368 |
| 7,752,790 | B1 * | 7/2010 | Michael | G09F 13/22 362/368 |
| 2009/0213586 | A1 * | 8/2009 | Peng | B60Q 1/2615 362/234 |
| 2011/0058352 | A1 * | 3/2011 | Ashby | G09F 13/20 362/34 |
| 2012/0055999 | A1 * | 3/2012 | Le Garrec | G06K 19/077 235/492 |
| 2012/0176789 | A1 * | 7/2012 | Van Herpen | F21V 21/0808 362/234 |
| 2012/0212946 | A1 * | 8/2012 | Shmuel | G09F 13/22 362/184 |

* cited by examiner

*Primary Examiner* — Laura Tso

(74) *Attorney, Agent, or Firm* — Braxton, Hilton & Perrone, PLLC

(57) ABSTRACT

A system and method for using LED sticker. The LED sticker has a top side and a bottom side. It has a positive lead and a negative lead, each coupled to a light emitting device. The LED sticker has first and second conductive surface which is electrically coupled to the leads. The LED sticker also has an adhesive used for adhering the sticker to a backing. When the circuit is complete, the light emitting device is activated. The circuit can be completed via any conductive medium, including conductive ink.

17 Claims, 6 Drawing Sheets

LED STICKERS

BACKGROUND OF THE INVENTION

1. Technical Field

The present invention relates to a system and method for using LED stickers.

2. Description of Related Art

Typical light emitting diodes used in lighting circuits must be soldered to wires thus making them cumbersome and unattractive when used in lighting traditional arts and crafts. There is a need to for a more efficient way to incorporate lights in to art, craft and educational curriculum without the need for soldering guns, heat and flux.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
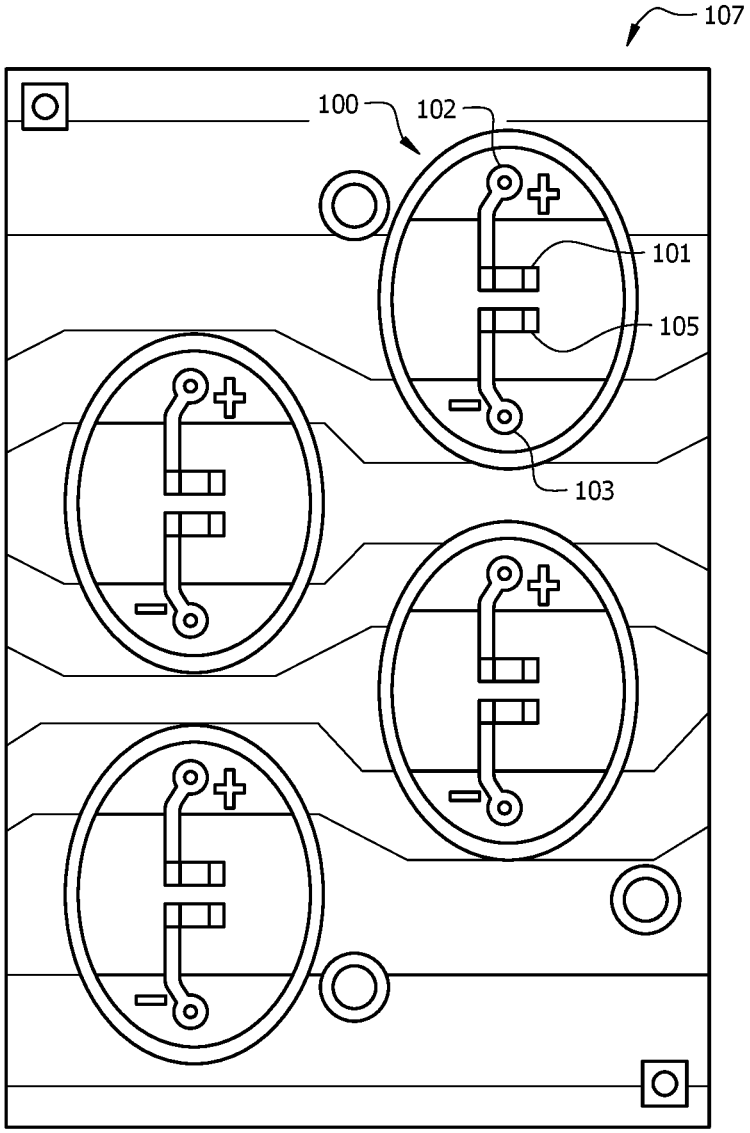
FIG. 1 is a top view of a sticker sheet in one embodiment.

FIG. 1 is a top view of a sticker sheet in one embodiment. As depicted, the sticker sheet comprises four LED stickers 100, but this is for illustrative purposes only and should not be deemed limiting. In other embodiments the sticker sheet 107 comprises only a single LED sticker 100, while in still other embodiments the sticker sheet 107 comprises two or more LED stickers 100. A sticker sheet refers to a sheet which releasably adheres one or more LED stickers. The LED sticker 100 can releasably adhere via adhesives, via score lines, or via any method known in the art which releasably secures a sticker in a sticker sheet. An LED sticker refers to a sticker which comprises a light emitting device.

Figure 2:
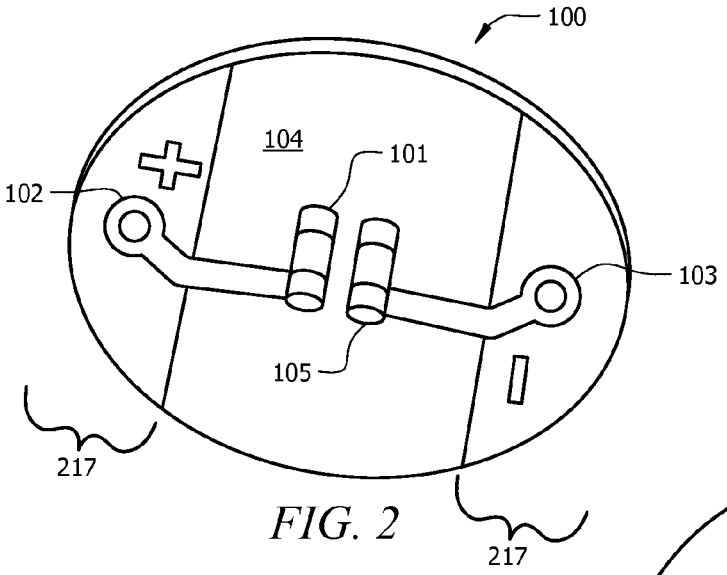
FIG. 2 is a top perspective view of a top side of a LED sticker in one embodiment.

FIG. 2 is a top perspective view of a top side of a LED sticker 100 in one embodiment. As depicted the top side has a positive lead 102, a negative lead 103, and a light emitting device 101. In one embodiment, the positive 102 and negative leads 103 rest atop the body 104.

The LED sticker 100 depicted comprises an oval shape. The positive 102 and negative leads 103 originate at the opposing ends 217 of the oval, with the light emitting device 101 located in the center. The oval shape is advantageous in that both the positive and negative sides have equal surface area, making it equally easy to electrically couple both sides of the LED sticker 100, as discussed in more detail below.

A light emitting device 101, as used herein, refers to any light emitting device known in the art including, but not limited to, light bulbs, LED lights, organic LED lights, etc. As can be seen, the light emitting device 101 is electrically coupled to both the positive lead 102 and the negative lead 103. As such, if the circuit is closed, electrical current flows to the light emitting device 101 through the positive lead 102 and the negative lead 103. As used herein, a circuit refers to a circuit which, when closed, allows for the flow of electricity.

The light emitting device 101 can comprise virtually any size or power requirement, depending upon the application. In one embodiment the light emitting device 101 comprises a Kingbright Standard LED manufactured by Kingbright of Industry City, Calif. Virtually any wattage can be utilized. In one embodiment the light emitting device 101 comprises a 120 mW.

Adjacent to the light emitting device 101 is a resistor 105. Virtually any type or size of resistor can be utilized. In one embodiment a thick film, a 0604 package, 1/10 W, 5% resistive tolerance resistor is utilized.

The positive 102 and negative leads 103 can comprise virtually any conductive material, including but not limited to, copper, metal, wire, conductive mediums such as conductive ink, etc. In one embodiment, and as depicted, the positive 102 and negative leads 103 comprise a thin, approximately linear shape. A linear shape is a shape which resembles a thin line. Leads comprising a linear shape have several advantages. First, owing to the linear shape, the leads require less material. Less material reduces the cost of the LED sticker 100 compared to a sticker which had larger leads. Second, smaller leads result in decreased opportunity to short the leads. As depicted, the width of the leads is less than 25% of the width of the LED sticker 100 at its largest width. In one embodiment, the linear leads have a width, as oriented perpendicular to the length, of between about 0.5 mm and about 2 mm. As depicted, the leads extend from the light emitting device 101 to a point terminating within the boundary of the LED sticker 100.

The positive 102 and negative leads 103 are electrically isolated atop the sticker body 104. The sticker body 104 acts as an insulator to electrically isolate the positive and negative leads 103. In one embodiment the leads are coated with an insulating layer. The insulating layer prevents the leads from experiencing a short. The sticker body 104 can comprise virtually any non-conductive material. In one embodiment, the sticker body 104 comprises polyimide. In one embodiment, and as depicted, the sticker body 104 extends for the length of the LED sticker 100.

Staying with FIG. 2, it can be seen that the ends 217 of the ovals are separated. In one embodiment, the sticker body 104 is semi-transparent, and the separated ends of the ovals seen in FIG. 2 are really the adhesive covers 305 on the bottom side of the LED sticker. Accordingly, in one embodiment, the vertical lines at the border of the end 217 are not located on the top side, but instead show the ends of the below adhesive cover 305 through the semi-transparent body.

Figure 3:
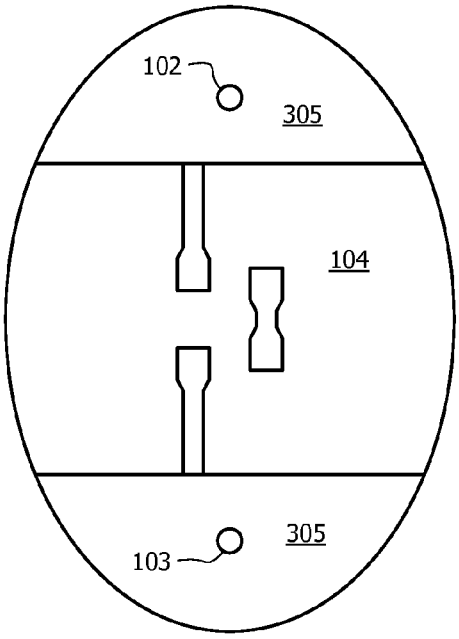
FIG. 3 is a planar view of a bottom side of a LED sticker in one embodiment.

FIG. 3 is a planar view of a bottom side of a LED sticker in one embodiment. The bottom side has an adhesive cover 305 on a first end and an adhesive cover 305 on a second end. As depicted and in one embodiment, the first and second adhesive covers 305 are not adjacent but are instead separated by a length of sticker body 104 which does not comprise an adhesive cover 305. This is an advantage in that less material is required, reducing the cost of the LED sticker 100.

Figure 4:
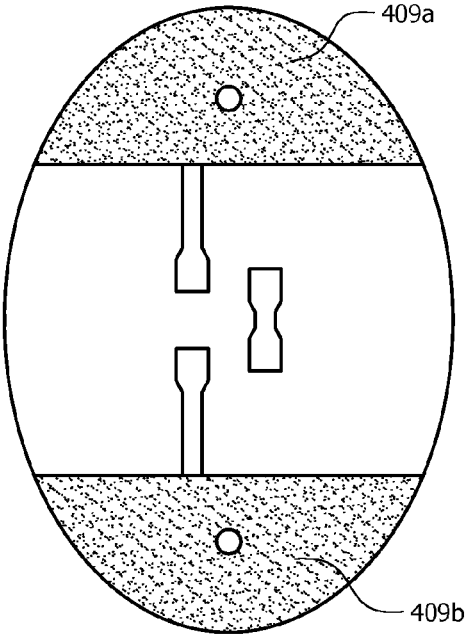
FIG. 4 is a planar view of a bottom side of a LED sticker with the adhesive cover removed.

Turning to FIG. 4, FIG. 4 is a planar view of a bottom side of a LED sticker with the adhesive cover 305 removed. The adhesive cover 305 can be removed via any method known in the art including peeling the adhesive cover 305. In one embodiment, upon removing the LED sticker 100 from the sticker sheet 107, the adhesive cover 305 is simultaneously removed. In one embodiment, and as depicted, once the adhesive cover 305 is removed then the conductive surface 409*a,b* is exposed. Accordingly, the adhesive cover 305 protects the underlying conductive surface 409*a,b* and prevents it from unintentionally adhering to an object.

A conductive surface 409*a,b*, refers to any surface which conducts electricity. The conductive surface 409*a,b* can comprise metal, conductive inks or other conductive mediums, etc. In one embodiment the conductive surface 409*a,b* comprises an adhesive. This allows the LED sticker 100 to be placed upon a backing (not depicted), as discussed in more detail below.

Virtually any type of adhesive which is adhesive can be utilized. This includes, but is not limited to, conductive tape, conductive adhesives or glues, etc. Examples of suitable adhesives include conductive tape, copper tape, TZ-6208, silver, nickel, copper.

As depicted, the bottom side of the LED sticker 100 comprises a first conductive surface 409*a* coupled to the positive lead 102, and a second conductive surface 409*b* coupled to the negative lead 103. The leads electrically couple the top side to the bottom side. As depicted, the first and second conductive surfaces 409*a,b* are not adjacent and do not touch. Such an arrangement would result in a short, and the light emitting device 101 would not function. Instead, the first and second conductive surfaces 409*a,b* are separated by a distance sufficient to prevent a short. The distance of separation can range from about $1/8^{th}$ of an inch to about 1 inch.

Figure 5:
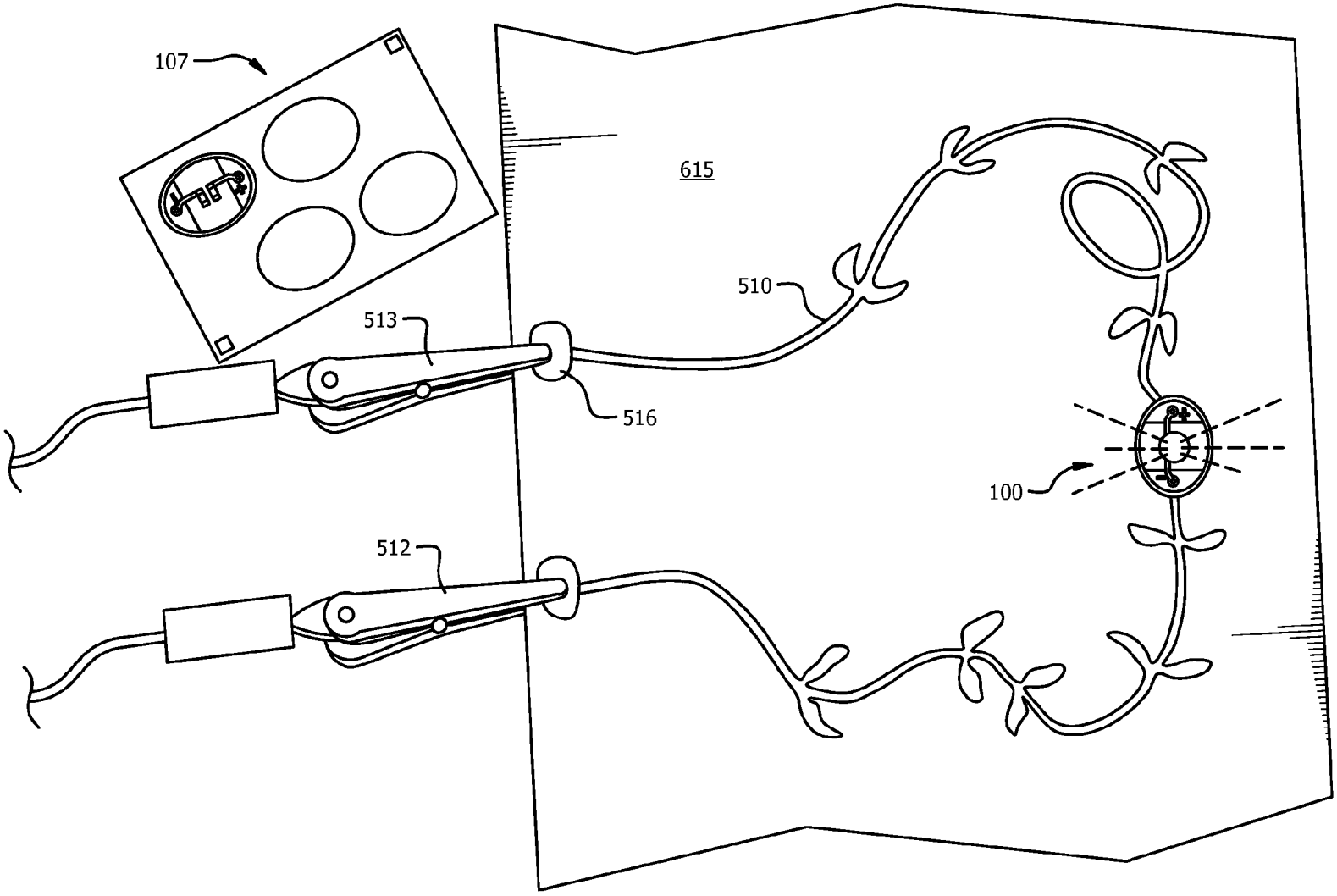
FIG. 5 is a top view of an embodiment utilizing the LED sticker in one embodiment.

FIG. 5 is a top view of an embodiment utilizing the LED sticker in one embodiment. As can be seen, the LED sticker 100 is electrically coupled with a conductive medium 510. The conductive medium 510 closes the circuit between the power source negative lead 513 and the power source positive lead 512 causing the light emitting device 101 to operate.

The conductive medium 510 can comprise any conductive material. The conductive medium 510 can comprise wire, conductive yarn or thread, conductive ink, conductive paint, etc. As depicted, the conductive medium 510 comprises conductive ink. Conductive ink or paint allows the user to simply deposit the conductive ink or paint on the backing 615 via drawing, painting, etc. The conductive medium 510 can be deposited via any method known in the art.

The ability to draw to paint the conductive medium 510 onto the backing 615 provides several benefits. First, it provides a very creative and expressive method of utilizing circuitry in the arts and crafts industry. Because, in one embodiment, the conductive medium 510 is part of the art, this allows for the elimination of bulky and unattractive wires or metal leads. Thus, this allows the conductive medium 510 to be incorporated into the art. Second, because it can be applied via ink, painting, etc., the conductive medium 510 which completes the circuit can be intricate and complex. This is in stark contrast to using straight and rigid wires.

Second, the ability to draw and paint the conductive medium 510 provides an opportunity to learn circuits and circuitry. Thus, the system is a tool which can be used for science, technology, engineering, and math ("STEM") educational purposes.

The backing 615 can comprise any surface which can support a LED sticker 100 and the conductive medium 510. This includes, but is not limited to, paper, vinyl, fabric, cardboard, plastics, rubber, etc.

As depicted, the conductive medium 510 is electrically coupled with an connection zone 516. The connection zone 516 is an area which electrically couples the conductive medium 510 to a power source. The connection zone 516 can comprise the same or dissimilar material as the conductive medium 510. In one embodiment, the connection zone 516 comprises conductive medium 510 which comprises an increased surface area compared to the adjacent conductive medium 510. Increased surface area increases the likelihood that an electrical connection will be made by increasing the surface area which is suitable for an electrical connection. As seen, there is a connection zone 516 located at the power source positive lead 512 and the power source negative lead 513. As can be seen, the connection zone 516 offers a comparatively larger surface area with which to connect the leads.

In one embodiment, there is one or more connection zones 516 located beneath the LED sticker 100. In one embodiment there is a connection zone 516 for the positive lead and a separate connection zone 516 for the negative lead of the LED sticker 100.

As depicted, the power source negative lead 513 and the power source positive lead 512 are electrically coupled to a power source (not depicted). When the circuit is closed, the light emitting device 101 will emit light. If, however, one of the power source leads is removed, the circuit becomes open, and the light emitting device 101 will cease to operate light.

The power source can comprise any power source which supplies an electrical current. The power source can supply AC or DC power. Accordingly, the power source includes, but is not limited to, solar panels, power coming from the grid, batteries, watch batteries, etc.

Figure 6:
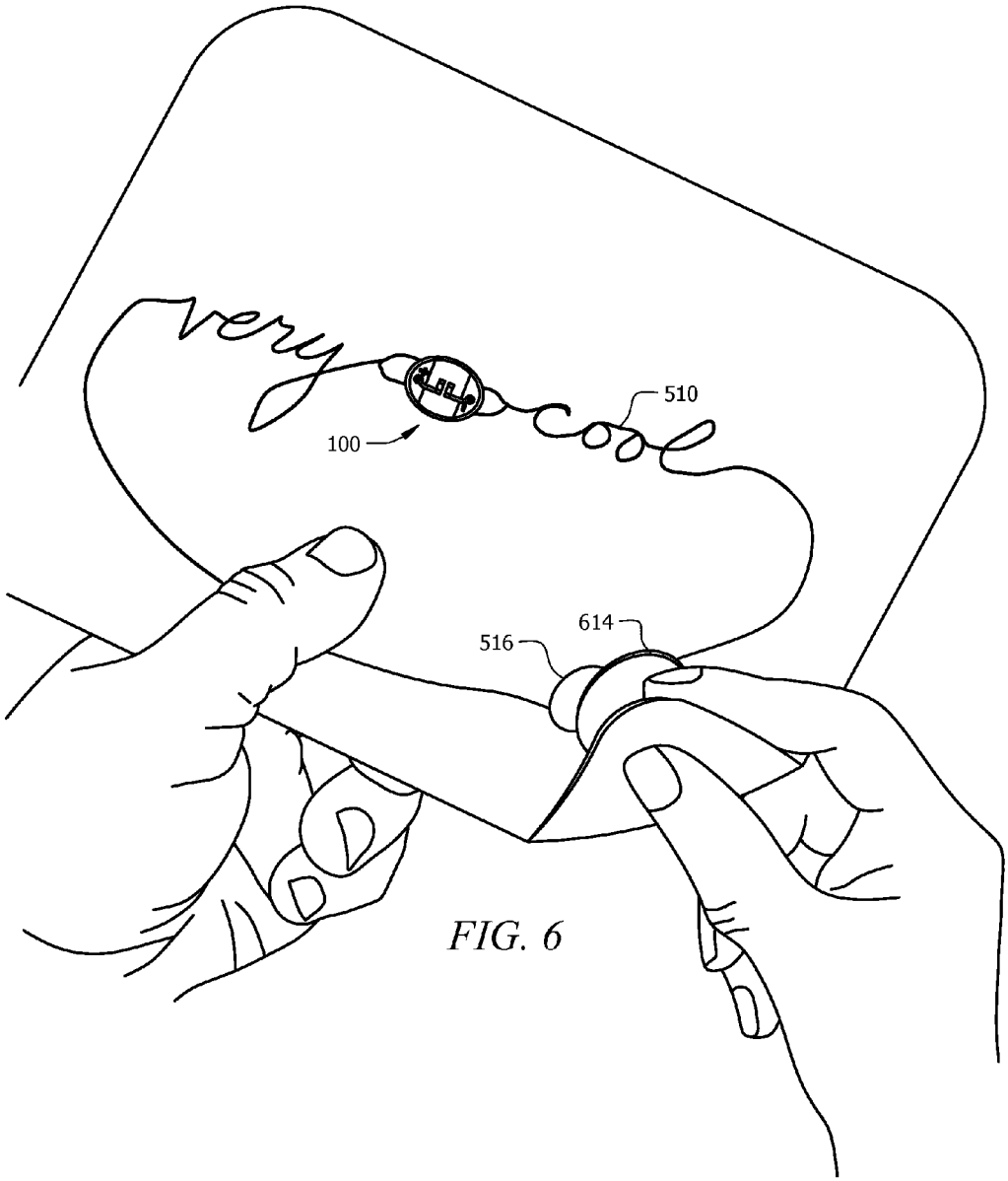
FIG. 6 is a top view of an embodiment utilizing the LED sticker with a power source in one embodiment.

FIG. 6 is a top view of an embodiment utilizing the LED sticker with a power source in one embodiment. As can be seen, the conductive medium 510 is used to display a message. FIG. 6 further comprises a power source 614. As depicted, the power source 614 comprises a battery comprising a positive side and a negative side.

As shown, there is a connection zone 516 on one portion of the backing 615. Not depicted, but located on the corner of the backing 615 is a second connection zone 516. When both connection zones 516 are in contact with the power source 614, the circuit is closed. Thus, FIG. 6 illustrates one of the many ways in which the circuit can be closed. As depicted, a corner comprising a connection zone 516 is bent to make contact with the power source 614, thus completing the circuit. Those skilled in the art will appreciate the various methods to open and close the circuit. For example, in some embodiments the turning of a page in a book will close the circuit. In other embodiments, pulling of a tab will close the circuit. In still other embodiments a swinging or rotating object can be manipulated to close the circuit and control the light emitting device 100.

While one embodiment has been shown wherein the circuit comprises a simple circuit wherein the light emitting device 100 is either on or off, this is for illustrative purposes only and should not be deemed limiting. The circuit may further comprise additional features such as timing circuitry which causes the light emitting device to blink. Other features include, but are not limited to, color changing circuitry of light emitting devices, dimming capabilities, flickering capabilities, etc.

Furthermore, while a light emitting device 100 has been disclosed, this is for illustrative purposes only and should not be deemed limiting. In other embodiments virtually any device which can be electrically coupled to via conductive medium 510 can be utilized. This includes a noise maker, a buzzer, etc., which makes noise when the circuit is closed. Taken further, while a single light emitting device 100 has been demonstrated, this should not be deemed limiting. In other embodiments the LED sticker 100 comprises two or more light emitting devices 100 which operate as previously discussed. Accordingly, in some embodiments, the light emitting device 100 can comprise the shape of various designs, texts, messages, etc. Further, in some embodiments comprising two or more light emitting devices 101, the light emitting devices comprise two or more different colors. As such, there can be a green light emitting device 101 and a blue light emitting device 101 on the same LED sticker 100.

FIGS. 5 and 6 show the LED sticker 100 exposed. However, in other embodiments the LED sticker 100 is covered or partially covered with a cover. A cover can include a decorative cover which decorates the LED sticker 100. In one embodiment the cover comprises a translucent material such that the light from the light emitting device 101 is visible. The cover can comprise paper, fabric, ribbon, tissue paper, etc.

Figure 7:
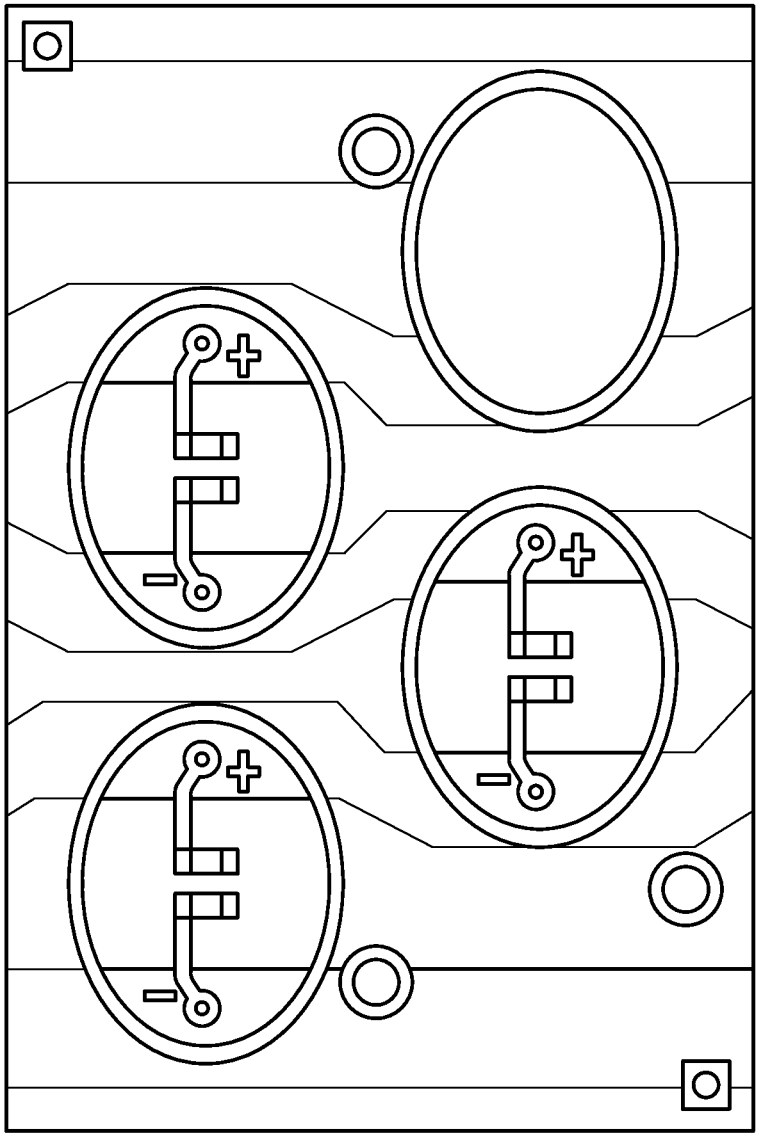
FIG. 7 is a top view of a sticker sheet with one LED sticker removed in one embodiment.

FIG. 7 is a top view of a sticker sheet with one LED sticker 100 removed in one embodiment. As can be seen, in one embodiment, when the LED sticker 100 is removed there is a void in the sticker sheet 107 that extends throughout the sticker sheet 107. Further, as depicted, there is a rim along the periphery of the LED sticker 100 that is below the LED sticker 100 which remains with the sheet 107 when the LED sticker 100 is removed.

Figure 8:
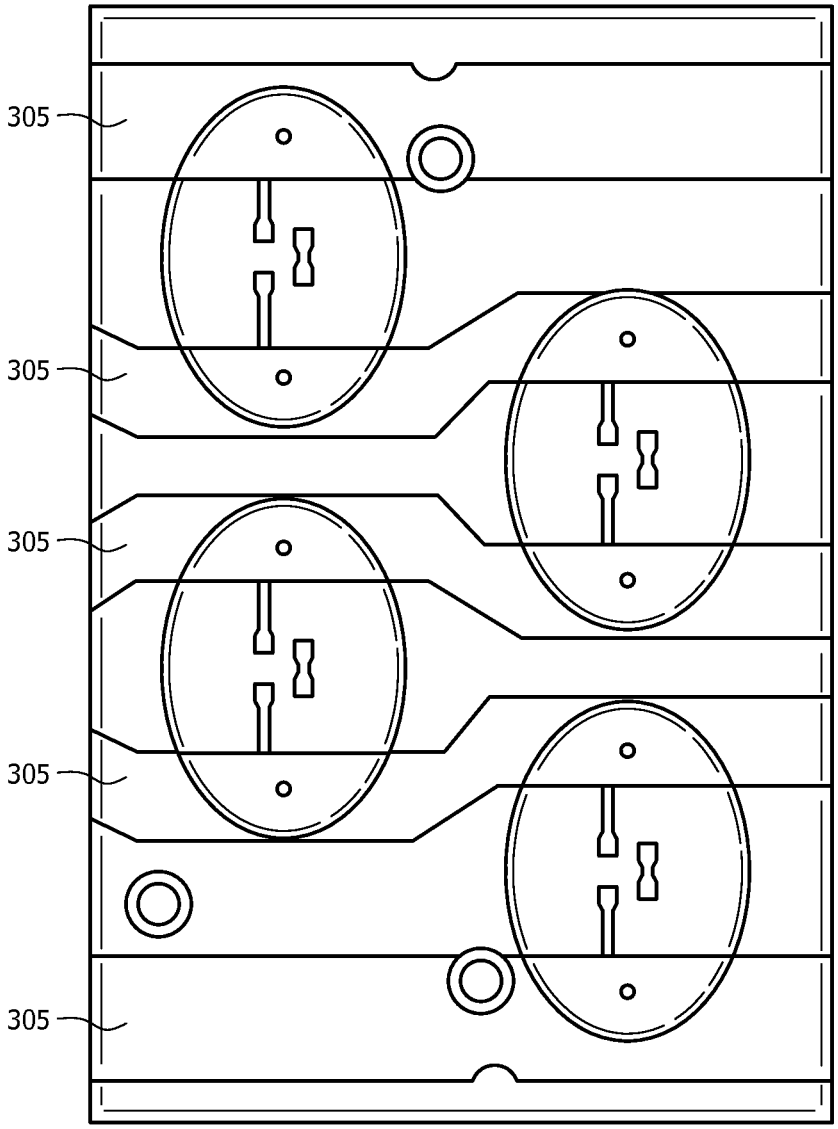
FIG. 8 is a bottom view of a sticker sheet in one embodiment.

FIG. 8 is a bottom view of a sticker sheet in one embodiment. As depicted in FIG. 8, adhesive cover 305 comprise a plurality of strips which cover the beneath conductive surface 409*a,b*. In one embodiment, these strips are die cut. Rather than cover the entire back sheet, these strips allows less material for the adhesive cover 305, reducing costs. In another embodiment, the adhesive cover 305 does not comprise strips, but instead comprises individual pieces which cover the conductive surface 409*a,b* only where needed. Such an embodiment decreases the amount of material used for the adhesive cover 305.

While one embodiment has been wherein the conductive surfaces are located on the bottom of the LED sticker 100, this is for illustrative purposes only and should not be deemed limiting. Referring to FIGS. 2 and 4, in one embodiment the conductive surface 409*a,b* is located atop the LED sticker 100 rather than on the bottom side. In such embodiments, the circuit can be completed by making contact with the conductive surface 409*a,b* located on the top side of the LED sticker 100. In one embodiment, the adhesive is still located on the bottom side of the LED sticker. In still other embodiments a conductive surface 409*a,b* is located on both the top and the bottom of the LED sticker 100. Such an arrangement provides for increased usability and functionality in that it allows either the top side or the bottom side to be conductive. In still other embodiments, the conductive surface 409*a,b* is both the top side and the bottom side. Put differently, the conductive surface 409*a,b* extends from the top side of the sticker to the bottom side of the sticker. Thus, a single conductive surface 409*a* is used for each of the respective ends. This is contrasted to an embodiment wherein one conductive surface 409*a* is used for the top of the sticker 100 and a second conductive surface 409*a* is used for the bottom of the sticker. Instead, a single conductive surface 409*a* is used. In such embodiments, the sticker body is adjacent to the conductive surface 409*a,b*.

As noted, the conductive surface 409*a,b* can be coupled, either directly or indirectly, to the top or bottom side of the sticker 100. Thus, the conductive surface 409*a,b* can be located atop the bottom side of the sticker 100, for example, or the conductive surface 409*a,b* can comprise the bottom side of the sticker 100.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

Clause 1. A LED sticker comprising:
- a top side and a bottom side;
- a positive lead and a negative lead each coupled to a light emitting device;
- a first conductive surface coupled to the bottom side, wherein said first conductive surface is electrically coupled to said positive lead;
- a second conductive surface coupled to the bottom side, wherein the second conductive surface is electrically coupled to the negative lead;
- wherein the first and second conductive surfaces are adhesive.

Clause 2. The LED sticker of any proceeding or preceding claim 1 wherein said positive and negative leads are located atop said top side.

Clause 3. The LED sticker of claim 1 further comprising an adhesive cover located atop said first and second conductive surfaces.

Clause 4. The LED sticker of any proceeding or preceding claim comprising a sticker sheet which comprises one or more LED stickers.

Clause 5. The LED sticker of any proceeding or preceding claim wherein said leads comprise a linear shape.

Clause 6. The LED sticker any proceeding or preceding claim further comprising a resistor.

Clause 7. The LED sticker of any proceeding or preceding claim wherein said light emitting device comprises an LED.

Clause 8. The LED sticker of any proceeding or preceding claim wherein said first and second conductive surfaces further comprise an adhesive cover.

Clause 9. A system for using a LED sticker, said system comprising:
- a backing;
- a LED sticker which can be adhered to said backing, said LED sticker comprising:
  - a top side and a bottom side;
  - a positive lead and a negative lead each coupled to a light emitting device;
  - a first conductive surface, wherein said first conductive surface is coupled to said positive lead;
  - a second conductive surface, wherein the second conductive surface is coupled to the negative lead;
  - an adhesive located on the bottom side;
- a conductive medium applied to said backing and electrically coupled to said LED sticker.

Clause 10. The system of any proceeding or preceding claim further comprising a power source.

Clause 11. The system of any proceeding or preceding claim wherein said conductive medium comprises a conduct ink.

Clause 12. The system of any proceeding or preceding claim further comprising a cover which at least partially covers said LED sticker.

Clause 13. The system of claim 9 wherein said first conductive surface and said second conductive surface are located on the bottom side.

Clause 14. The system of any proceeding or preceding claim wherein said first and second conductive surfaces comprise an adhesive.

Clause 15. The system of any proceeding or preceding claim wherein said first and second conductive surfaces comprise an adhesive cover.

Clause 16. The system of any proceeding or preceding claim wherein said first conductive surface and said second conductive surface are located on the top side.

Clause 17. The system of any proceeding or preceding claim wherein said leads comprise a linear shape.

Clause 18. A LED sticker comprising:

a top side and a bottom side;

a positive lead and a negative lead each coupled to a light emitting device;

a first conductive surface located on the top side, wherein said first conductive surface is electrically coupled to said positive lead;

a second conductive surface located on the top side, wherein the second conductive surface is electrically coupled to the negative lead;

an adhesive coupled to said bottom side.

Clause 19. The LED sticker of any proceeding or preceding claim wherein said leads comprise a linear shape.

What is claimed is:

1. A LED sticker comprising:

a top side and a bottom side;

a positive lead and a negative lead each coupled to a light emitting device;

a first conductive surface coupled to the bottom side, wherein said first conductive surface is electrically coupled to said positive lead;

a second conductive surface coupled to the bottom side, wherein the second conductive surface is electrically coupled to the negative lead;

wherein the first and second conductive surfaces are adhesive.

2. The LED sticker of claim 1 wherein said positive and negative leads are located atop said top side.

3. The LED sticker of claim 1 further comprising an adhesive cover located atop said first and second conductive surfaces.

4. The LED sticker of claim 1 comprising a sticker sheet which comprises one or more LED stickers.

5. The LED sticker of claim 1 wherein said leads comprise a linear shape.

6. The LED sticker of claim 1 further comprising a resistor.

7. The LED sticker of claim 1 wherein said light emitting device comprises an LED.

8. The LED sticker of claim 1 wherein said first and second conductive surfaces further comprise an adhesive cover.

9. A system for using a LED sticker, said system comprising:

a backing;

a LED sticker which can be adhered to said backing, said LED sticker comprising:

a top side and a bottom side;

a positive lead and a negative lead each coupled to a light emitting device;

a first conductive surface, wherein said first conductive surface is coupled to said positive lead;

a second conductive surface, wherein the second conductive surface is coupled to the negative lead;

an adhesive located on the bottom side;

a conductive medium applied to said backing and electrically coupled to said LED sticker.

10. The system of claim 9 further comprising a power source.

11. The system of claim 9 wherein said conductive medium comprises a conduct ink.

12. The system of claim 9 further comprising a cover which at least partially covers said LED sticker.

13. The system of claim 9 wherein said first conductive surface and said second conductive surface are located on the bottom side.

14. The system of claim 13 wherein said first and second conductive surfaces comprise an adhesive.

15. The system of claim 14 wherein said first and second conductive surfaces comprise an adhesive cover.

16. The system of claim 9 wherein said first conductive surface and said second conductive surface are located on the top side.

17. The system of claim 9 wherein said leads comprise a linear shape.

* * * * *